United States Patent [19]

Ganz

[11] 4,221,415

[45] Sep. 9, 1980

[54] CANINE WASTE DISPOSAL APPARATUS

[76] Inventor: Samuel Ganz, 3065 Sedgewick Ave., Bronx, N.Y. 10468

[21] Appl. No.: 958,113

[22] Filed: Nov. 6, 1978

[51] Int. Cl.[2] ..... A01K 29/00

[52] U.S. Cl. ..... 294/1 BA

[58] Field of Search ..... 294/1 B, 1 BA, 1 BB, 294/19 R, 51, 52, 53.5, 55; 15/104.8, 257.1, 257.4, 257.7

[56] References Cited

U.S. PATENT DOCUMENTS

| | | | |
|---|---|---|---|
| 1,104,470 | 7/1914 | Bilson | 294/118 |
| 3,560,039 | 2/1971 | Gruber | 294/1 B |
| 3,677,596 | 7/1972 | Yonaites et al. | 294/1 BA |
| 3,703,158 | 11/1972 | Lemler | 294/1 B |
| 3,716,263 | 2/1973 | Gatti | 294/1 BA |
| 3,768,851 | 10/1973 | Freeman | 294/1 BA |
| 3,868,135 | 2/1975 | Magliaro | 294/1 BB |
| 3,912,316 | 10/1975 | Veech | 294/1 BA |

FOREIGN PATENT DOCUMENTS

| | | | |
|---|---|---|---|
| 2263681 | 11/1975 | France | 294/1 BB |

*Primary Examiner*—Johnny D. Cherry
*Attorney, Agent, or Firm*—Natter & Natter

[57] ABSTRACT

A canine waste disposal apparatus having pivotally connected first and second frame elements adapted for retaining a disposable sanitation sheet such as paper towelling. The first frame element is rotationally displaceable with respect to the second frame element for enveloping waste contents within the sanitation sheet. An elongated handle is attachable to the second frame element for use in manipulating the apparatus into position for receiving animal deposits. In an alternate mode of operation, the handle is attachable to the first frame element. The second frame element is rotatably movable to a position overlying the first element with the sanitation sheet being folded over the waste contents.

7 Claims, 9 Drawing Figures

FIG. 1
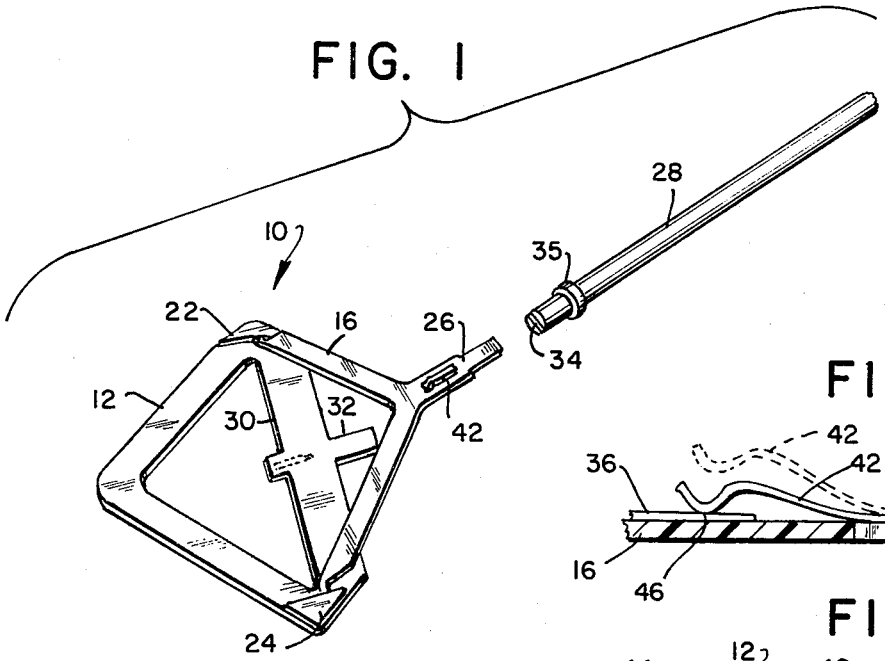
FIG. 3
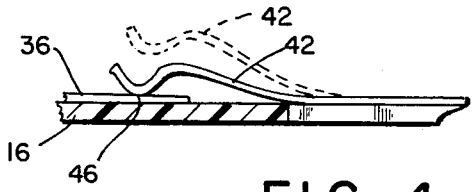
FIG. 4
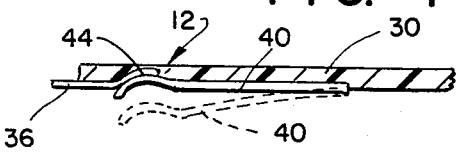
FIG. 5
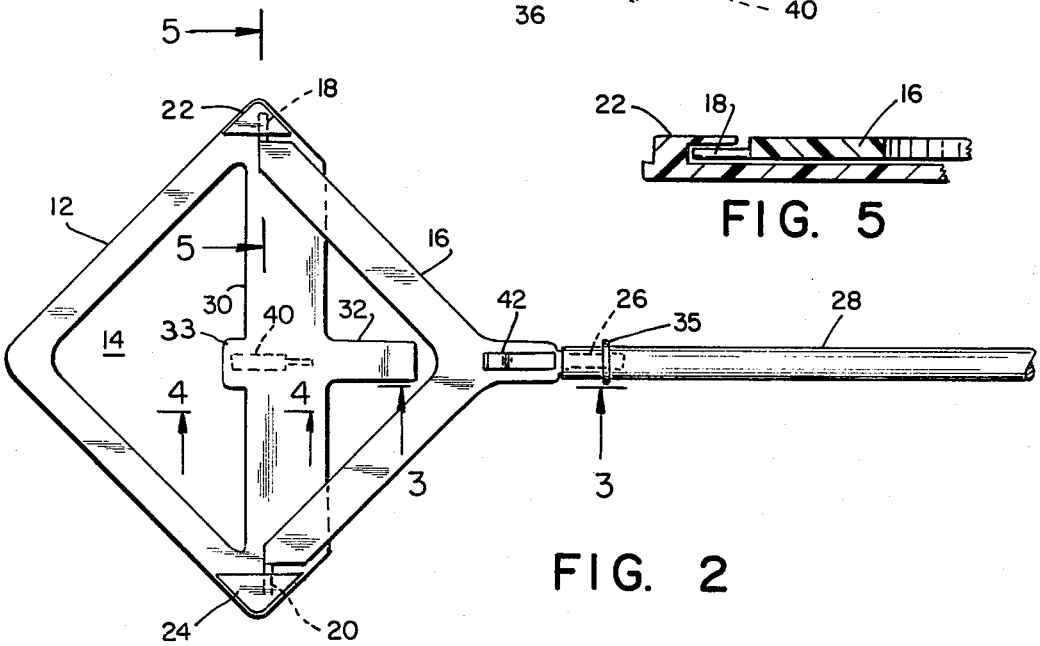
FIG. 2

FIG. 6
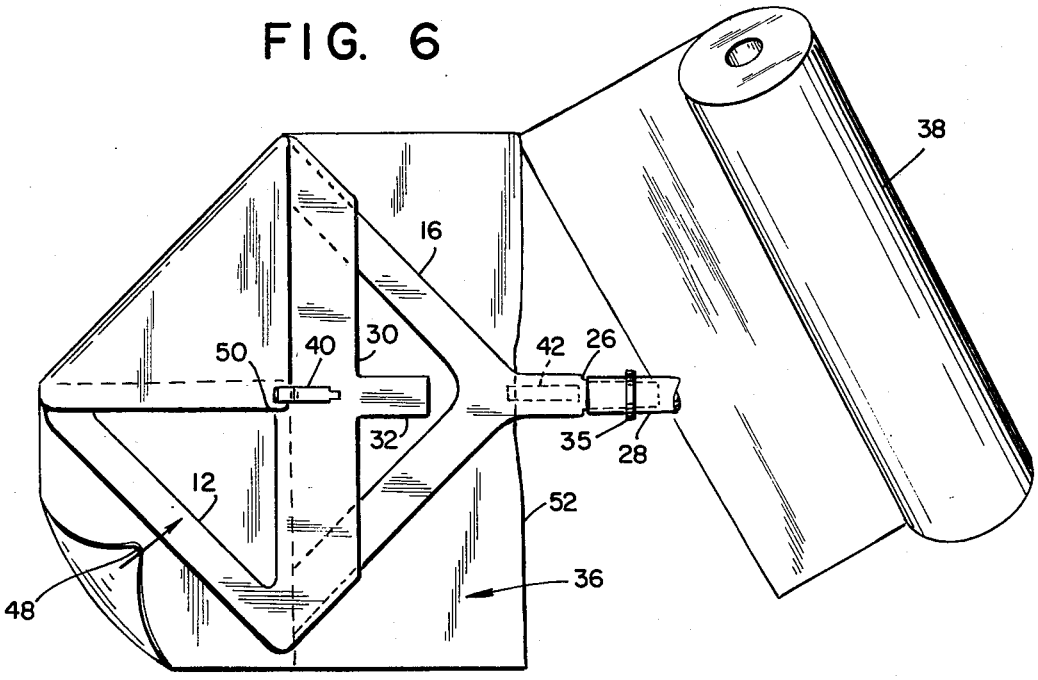
FIG. 8
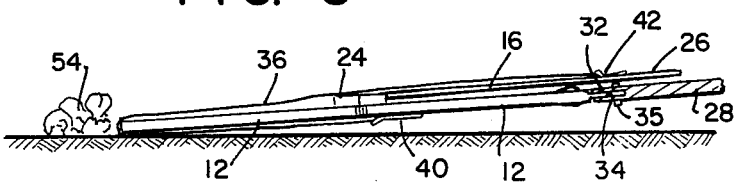
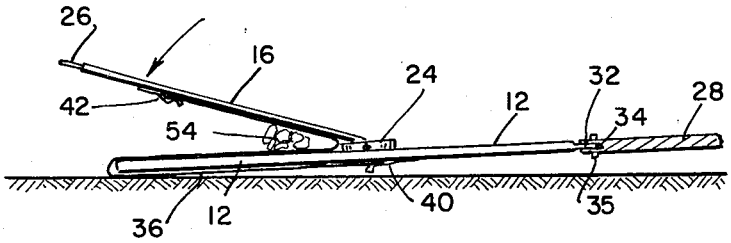
FIG. 9
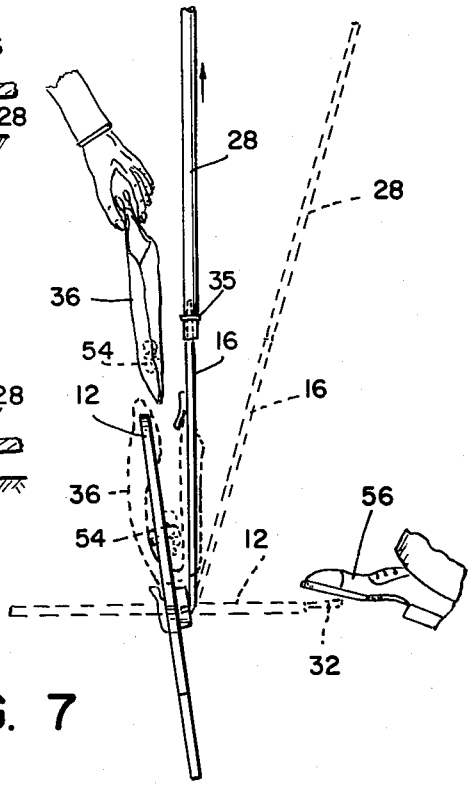
FIG. 7

CANINE WASTE DISPOSAL APPARATUS

BACKGROUND OF THE INVENTION

1. Field of the Invention

This invention is concerned with a waste collection device and especially to an apparatus for the sanitary removal and/or pick-up of animal excrement, putrescible substances and other similarly offensive materials.

2. Description of the Prior Art

The indiscriminate littering by pets, such as dog droppings, particularly within an urban environment, can create both a nuisance to pedestrians as well as a health problem. Some municipalities have attempted to place strict control on dog owners and ordinances have been enacted in some localities which require dog owners to clean up after their animals.

Various types of sanitary disposal apparatus have been developed in an attempt to provide an efficient and convenient implement for such purposes. In many instances, these devices include a holder together with an interfitting container which is discarded after suitable collection. Such prior art devices are typically illustrated by U.S. Pat. Nos. 3,767,246, 3,786,780 and 3,819,220. An inherent disadvantage of the aforementioned devices is that they require a specific size or shape receptacle and their supply must be constantly replenished or the device is in all respects useless. Furthermore, the intended method of operation is limited to the specific mode wherein the receptacle is placed beneath a pet to receive the waste material as it is discharged. If the excrement has already been deposited on the ground, these prior art devices do not provide for removal as by scooping. A collecting device using a scooping action such as shown in U.S. Pat. No. 3,281,178 utilizes a special collecting bag and further does not provide for immediate collection of the waste material prior to disposition on the ground surface.

The present invention in contrast is designed for directly receiving animal droppings and/or in an alternate mode of operation for pick-up of already deposited waste. In addition, a feature of this invention is that custom fitted containers or receptacles are not required, and the instant apparatus is further adapted for use with sanitation sheets of various forms such as paper towelling, individual paper hand towels, napkins, newspaper, etc. These materials are readily available to the pet owner and do not require special purchases as with collection bags and receptacles. In addition, this device provides for the convenient and sanitary disposal of the sanitation paper and its contents.

It should thus be apparent that the canine waste disposal device of this invention overcomes many of the disadvantages and shortcomings of the prior art. A feature therefore of this invention is that it provides a useful implement for the sanitary removal and disposal of animal excrement without the necessity of any special or custom fitted bags or containers. In addition, this device provides two distinct modes of operation.

SUMMARY OF THE INVENTION

Briefly, the nature of this invention relates to a canine waste disposal apparatus. The intended purpose of this device is to provide an implement for the sanitary removal of waste deposits, such as pet droppings; however other applications thereof will be apparent.

The device of this invention includes a pair of pivotally interconnected open frame elements and a detachable elongated handle; the handle being attached to either of the frame elements depending upon the particular situation encountered. The frame elements are provided with resilient clasp or clip members for retaining a sanitation sheet covering the open portion of each frame element. The sanitation sheet can be a single sheet from a roll of paper towelling or an individual paper hand towel, and is designed to receive and retain the animal excrement for sanitary disposal. The pivotal arrangement of the frame members provides a method for envelopment of the waste contents within the sanitation sheet whereby the sheet can be removed from the frame elements by releasing the clasp members and then disposed of.

In one mode of operation, the handle is secured to a second frame element and so manipulated that the first pivotally supported frame element is positioned in a substantially horizontal position primarily to catch animal droppings, although it can also function as a scoop.

In an alternate procedure, the handle is attached to the first frame element which can then be slid along the ground surface in a scooping action to pick up material which has been deposited on the surface. This arrangement can also be used to directly receive the canine waste. In either instance, the pivotal action of the frame elements provides a procedure for enveloping the waste within the sanitation sheet so that it can be removed in a sanitary manner for disposal.

A feature of this invention is that the open frame elements can be manufactured of thermoplastic material such as polypropylene, and as a result of the simplicity in its design is relatively easy and economical to manufacture.

Having thus summarized the invention, it will be seen that it is an object thereof to provide a canine waste removal apparatus of the general character described.

Specifically, it is an object of this invention to provide a canine waste removal apparatus adapted to retain a sanitation sheet for containing waste material.

A further object of this invention is to provide a canine waste removal apparatus having hingedly connected frame elements adapted for holding a disposable sanitation sheet with the respective elements being closable upon each other to envelop waste material therein for sanitary removal.

Another object of this invention is to provide a canine waste removal apparatus having two separate modes of opertion.

It is a further object of this invention to provide a canine waste removal apparatus which is simple in design, economical to manufacture and efficient in its operation.

Other objects of this invention in part will be apparent and in part will be pointed out hereinafter.

With these ends in view, the invention finds embodiment in certain combinations of elements, and arrangements of parts by which the objects aforementioned and certsain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown the preferred embodiment of the invention:

FIG. 1 is a perspective view of a canine waste removal apparatus of this invention showing the pivotally connected first and second open frame elements with a handle attachable to the second frame element;

FIG. 2 is a plan view of the device shown in FIG. 1 to a slightly enlarged scale showing the pivotally interconnected open frame elements and a portion of the detachable elongated handle;

FIG. 3 is a sectional view to an elongated scale taken substantially along line 3—3 of FIG. 2 showing a retaining clip mounted to the second frame element;

FIG. 4 is a sectional view to a slightly enlarged scale taken substantially along line 4—4 of FIG. 2 showing a retaining clip mounted to the first frame element;

FIG. 5 is a sectional view to a slightly enlarged scale taken along line 5—5 of FIG. 2 showing a portion of the hinged connection between the first frame element and the second frame element;

FIG. 6 is a plan view of the reverse side of the frame elements as shown in FIG. 2 further illustrating a sheet of towelling removed from a supply roll and partially secured to the frame elements, a free end of the sheet is moved in he direction of the arrow and will assume a position as noted by the broken line;

FIG. 7 is a representation of the apparatus showing the cooperation between the pivotally connected frame elements and the manner in which the paper towelling is removed, the broken line illustrating the loading position with the solid line showing the position for removing the waste contents;

FIG. 8 is a side elevational view showing the device for use as a scoop with the handle being attached to the first frame element;

FIG. 9 is a sectional view illustrating the manner in which the second frame element is rotated to a position overlying the first frame element with the paper towelling enveloping the waste deposit.

DESCRIPTION OF THE PREFERRED EMBODIMENT

Referring now in detail to the drawings, specifically FIG. 1, reference numeral 10 denotes generally a canine waste removal appartus constructed in accordance with this invention. The device 10 includes a first frame member 12 being generally triangular in shape and having an open segment 14. A companion bifurcated second frame element 16 is provided with an integral pivot pin 18, 20 at the terminal ends of each leg which is adapted for hinged connection to the first frame element 12. For this purpose the frame element 12 contains a pin receptacle 22, 24, for rotatably receiving the respective pins 18, 20.

The apex of the frame element 16 has a tongue coupling member 26 adapted for interfitting connection to a slender elongated handle 28. The frame element 12 is further provided with a balance cross-beam 30, which will be discussed hereinafter and also has a tongue coupling member 32 being substantially identical to the coupling 26. It will hereinafter become apparent that the handle 28 can be interchangeably connected to either the frame element 16 or to the frame element 12. For this purpose, handle 28 is provided with a slotted opening 34 for accommodating either tongue coupling member 26, 32. The coupling member 26, 32, when inserted into the slot 34, causes the surrounding portion of handle 28 to expand slightly and a compressive locking force can then be applied using a clamp or slidable ring 35.

Alternate forms of releasable couplings can also be used, for example, the handle 28 can be provided with a threaded shank portion and the coupling member formed tubularly with internal threads.

The frame elements 12, 16 are preferably made of thermoplastic material such as polypropylene which can be injection molded so that the device 10 will be economical to manufacture, durable in strength, and relatively light in weight. Furthermore, this material provides the necessary yieldability so that the frame element 16 can be flexed during assembly and the pivot pins 18, 20 can be snapped into their respective pin receptacles 22, 24. The handle 28 in the preferred embodiment is constructed of wood, however, the invention also contemplates use of thermoplastic, aluminum alloy or like materials. The handle 28 can also be telescopically collapsible for easy storage. In addition, the handle 28 can be curved or otherwise shaped to minimize bending and to facilitate usage.

The intended manner of use contemplates the affixing to the frame elements 12, 16 upon each application, of a fresh sanitation sheet 36. As previously noted, a feature of this invention is that the sanitation sheet 36 need not be in the form of a special receptacle or a custom fitted collection bag; any of a number of sheet materials have been found suitable. FIG. 6 illustrates a single section of paper towelling as removed from supply roll 38; other materials such as individual hand towels, nakins, newspaper and the like can also be used for this purpose. The size of the sanitation sheet 36 should be compatible with the dimensions of the frame elements 12, 16, and is generally square in configuration. A towel section, typically 27.5×27.5 cm.) is used in the preferred embodiment shown. The paper towelling has been found to provide the necessary strength and absorbency characteristics for this intended use.

The manner of attaching the sanitation sheet 36 will now be discussed with reference to FIGS. 3, 4 and 6. It should first be noted that the frame elements 12, 16 are provided with clasps or retaining clips 40, 42. These clips 40, 42 may be fabricated of a similar thermoplastic material and formed unitarily with the respective frame elements 12, 16 or alternatively other forms of yieldable fasteners may be employed; for instance, metal spring clips.

In the preferred embodiment, plastic resilient clips 40, 42 are formed integrally or secured to the respective frame elements 12, 16 by means of a plastic solvent or adhesive in a conventional manner. The clips 40, 42 are flexibly displaceable as shown by the broken line drawings in respective FIGS. 3 and 4 and furthermore, a contact surface 44, 46 is scored, provided with dimpling or otherwise roughened to improve frictional gripping of the sanitation sheet 36. With regard to the clip 40, this is recessed somewhat within the balance beam 30 so that the frame element 12 can be placed in a substantially horizontal position on the ground surface. It should be noted that the cross-beam 30 is provided with a lip 33 so that the clip 40 when mounted, will project into the open segment 14. This facilitates securement of the sanitation sheet 36 and provides more flexibility in use of the device by accommodating sheets within a range of acceptable dimensions.

Further discussing the securement of the sanitation sheet 36, the frame elements 12, 16 are placed on a horizontal surface over the sanitation sheet 36 as shown in FIG. 6. Each of two respective ends 48, 50 are secured under clip 40. The remaining free edge 52 is then fastened to the frame element 16 by means of retainer clip 42. The device 10 is now ready for operation use. It should be noted that both frame elements 12, 16 are completely protected by the sanitation sheet 36.

In one mode of operation, the handle 28 is secured to the coupling 26 of the frame element 12 whereby the frame element 12 can be positioned in a generally horizontal orientation by manipulation of the handle 28. The plane defined by the first frame element is disposed at an angle of at least 90° and preferably greater than 90° from the plane defined by the second frame element. This is generally illustrated in FIG. 1 with the sheet 36 omitted for clarity and also by the brokn line drawing in FIG. 7. When so used, dog feces 54 can be deposited directly on the sanitation sheet 36. Thereafter, the handle 28 can be lifted upwardly causing the element 12 to rotate toward a substantially vertical plane as illustrated in FIG. 7.

At this point it should be noted that the center of gravity of the frame element 12 does not coincide with the axis of rotation as defined by the pin bearing 22, 24, particularly because of the added weight and its distribution as contributed by the balance beam 30. When the frame element 16 is in a substantially vertical plane, the frame element 12 will rotate about the pivot pins 18, 20 in a clockwise direction as shown in the drawings (FIG. 7) to a substantially vertical plane.

In the event the waste material is equal to or greater than the force attributed by the cross-beam 30 such that rotation does not readily occur, movement of the frame element 12 can be assisted by placement of the operator's toe 56 on coupling 26 as shown in FIG. 7, while at the same time lifting handle 28.

The sanitation sheet 36 will substantially envelop the waste deposited which can be removed by releasing the respective clips 40, 42 or alternatively by gently tugging upon the sanitation sheet 36 to slide same from beneath the respective clips. The material 54 will thus be compactly packaged for sanitary disposal.

In an alternate mode of operation, the handle 28 may be attached to coupling 32 on the first frame element 12. When so used it is desirable for the handle 28 to have a slight curvature so that the user does not have to bend in order to hold the first frame element close to the ground surface. The sanitation sheet 36 is attached as previously described; the device is ready to catch animal droppings or for use as a scoop as illustrated in FIGS. 8 and 9. When using the device as a scoop, an additional implement may be needed to aid loading the waste material 54 onto the sanitation sheet 36. After the material 54 is on the sheet 36 the second frame element 16 can then be manually rotated by grasping coupling 26 by hand or by pushing it with the operator's toe to move same to a position overlying the first frame element 12. The sheet 36 will then envelop the waste material 54 which can then be disposed of in a sanitary manner.

Thus it will be seen that there is provided an animal waste removal apparatus which achieves the various objects of the invention and which is well adapted to meet conditions of practical use.

Since various possible embodiments might be made of the present invention and several changes might be made in the exemplary embodiments above set forth, it is to be understood that all materials shown and described in the accompanying drawings is to be interpreted as illustrative and not in a limiting sense.

Having thus described the invention, there is claimed as new and desired to be secured by Letters Patent:

1. A canine waste disposal apparatus comprising a first frame member, a second frame member pivotally interconnected to the first frame member, independent fastening means on said frame members for releasably securing foldable sanitation sheet material, elongate handle means to envelop waste deposits within the sheet material whereby the collected waste can be removed for disposal.

ing one of said frame members to rotatably close upon the other of said frame members when suspended by the handle means to envelop wste deposits within the sheet material whereby the collected waste can be removed for disposal.

2. A canine waste disposal apparatus as claimed in claim 1 wherein the weight distribution means includes a cross beam on the first frame member, said cross beam being positioned so that the rotational axis through the pivotal interconnection with the second frame member is noncoincident with the center of gravity of the first frame member to thereby create a rotational moment.

3. A canine waste disposal apparatus as claimed in claim 2 wherein the sanitation sheet material is paper towelling.

4. A canine waste disposal apparatus as claimed in claim 1 wherein the sanitation sheet material is adapted to cover a portion of both the first and second frame members.

5. A canine waste disposal apparatus as claimed in claim 1 wherein the first frame member is adapted to retain a portion of the sanitation sheet material in a substantially horizontal plane and the second frame member is adapted to retain another portion of the sanitation sheet material disposed at an angle of at least 90 degrees from the horizontal plane when the apparatus is in a waste receiving mode.

6. A canine waste disposal apparatus as claimed in claim 1 further including coupling means on the first and second frame members for interchangeably accepting the handle means to provide alternate modes for utilizing the apparatus.

7. A canine waste disposal apparatus as claimed in claim 1 wherein the independent fastening means comprises a resilient clip on at least one of said frame members for releasably retaining the sanitation sheet materail on the respective frame member.

* * * * *